US006840836B1

(12) United States Patent
Siverson

(10) Patent No.: US 6,840,836 B1
(45) Date of Patent: Jan. 11, 2005

(54) FLEXIBLE FLYING DISK

(76) Inventor: Cory A. Siverson, S. 2208 Greensferry Rd., Coeur d'Alene, ID (US) 83814

( * ) Notice: Subject to any disclaimer, the term of this patent is extended or adjusted under 35 U.S.C. 154(b) by 0 days.

(21) Appl. No.: 10/730,734

(22) Filed: Dec. 8, 2003

(51) Int. Cl.[7] ..... A63H 27/00
(52) U.S. Cl. ..... 446/46; 264/328.17
(58) Field of Search ..... 264/328.14, 328.16, 264/328.17; 473/588; 446/46, 47, 48

(56) References Cited

U.S. PATENT DOCUMENTS 4,737,128 A 4/1988 Moormann et al. ..... 446/273
5,199,717 A * 4/1993 Wimmer ..... 473/590
5,553,570 A * 9/1996 VanNatter et al. ..... 119/709

* cited by examiner

*Primary Examiner*—Jacob K. Ackun, Jr.
(74) *Attorney, Agent, or Firm*—Reidlaw, L.L.C.; James Price; John S. Reid

(57) ABSTRACT

A flexible flying disk is described in which a body having a circular perimeter is formed about a central axis. The body includes a weighted annular margin at the perimeter, with an axial margin dimension. A central web spans the perimeter at one axial end of the margin and includes an axial web thickness less than the axial margin dimension. The web and annular margin are integral and are formed of a thermosetting molded and heat cured catalyzed silicone.

19 Claims, 6 Drawing Sheets

FLEXIBLE FLYING DISK

FIELD OF THE INVENTION

The invention claimed and disclosed herein pertains generally to toys and more particularly to flexible flying disk toys and methods for producing such toys.

BACKGROUND

Flying disk toys have been popular play things with children and even adults for many years. What started as a metal, pie pan disk, is now a large industry and numerous forms of the disk shape have evolved over the years. One persistant problem, however, has been that the disks, even though formed of flexible plastic, can be somewhat dangerous. Relatively hard plastic disks thrown with force can chip or break teeth, or damage property.

As a solution to the above problem, softer disks have been produced. Fabric covered disks, and even more flexible rubber disks have been produced with some success. However, a need remains for a soft disk with maximum resilient flexibility, and excellent "memory" (that is, an inherent capability of returning to a preset form following physical distortion). Flexible disks that do not have almost infinite memory will not return completely to an original aerodynamic configuration following bending, and will not fly well following such bending.

In addition to the above, the need remains to concentrate maximum mass of a flying disk at the disk perimeter. Such mass concentration helps stabilize the disk in flight and increases flight duration and accuracy to a target. While this is a recognized need, flexible disk makers have apparently felt constrained to place a substantial mass inwardly of the disk perimeters. This may be explained in part by the materials and processes by which the disks are made. Plastic injection molding is a common manufacturing technique where molten plastic is forced into a mold. Thickness dimensions in injection molded parts are typically similar, due to the danger of unequal cooling. Unequal cooling times can result in undesired warping or twisting of the disk. Such results cannot be tolerated in the production of flying disks.

In recognition of the need for concentration of mass at the disk perimeter, some manufacturers have gone so far as to remove the web completely, leaving nothing more than a flat, flying ring. And the results have been quite good. A flying ring will sail substantial distances. However, the sacrifice made is that the rings are most usually made of relatively hard plastic and, if bent, will "remember" the bend and flying will be adversely affected.

There is also a need for a soft flexible flying disk toy that can be printed with graphics which will distort with the disk material and which will not crack or rub off.

In view of the above, what is needed is a flexible flying disk which achieves the benefits to be derived from similar prior art disks, but which adds new and unobvious aspects that avoid the shortcomings and detriments individually associated therewith.

SUMMARY

One aspect of the present invention includes a flexible flying disk with a body having a circular perimeter formed about a central axis. The body includes a weighted annular margin at the perimeter with an axial margin dimension. A central web spans the perimeter at one axial end of the margin, and includes an axial web thickness less than the axial margin dimension. The web and annular margin are integral and are formed of a thermosetting molded and heat cured catalyzed silicone.

Another aspect of the present invention includes a process for producing a flexible flying disk by providing a first mold part with an outwardly open cavity formed therein defining part of a circular flying disk configuration, and a second mold part with a mold surface thereon defining a remaining part of the circular flying disk configuration. This aspect also includes placing a pre-catalyzed volume of silicone within one of the mold parts, and pressing the mold parts together at a pressure equal to about 4000 pounds per square inch of projected surface area of the flying disk configuration. Additionally the process includes heating the mold parts to a temperature of about 350 degrees Fahrenheit for a time period of between about 2 and 10 minutes to cure the precatalyzed silicone, and separating the mold parts to allow removal of the cured flying disk.

A still further aspect of the present invention includes a flexible flying disk in which a body is formed of heat cured silicone having a Shore A durometer hardness of between about 20 and 60, and having a circular perimeter with a diameter of between about 4 and 8 inches centered on a central axis. The body includes a weighted annular margin at the perimeter which includes an axial margin dimension that is about 0.11 (i.e., about 11%) of the diameter. A central web spans the perimeter at one axial end of the margin, and includes an axial web thickness that is about 0.007 (i.e., about 0.7%) of the axial margin dimension. The web and annular margin are integral.

Another aspect of the present invention includes a process for producing a flexible flying disk which includes providing a mold formed of two separable parts that together form a flying disk shaped cavity, and heating the mold to about 350 degrees Fahrenheit. The process further includes injecting liquid catalyzed silicone into the heated mold, and curing the injected liquid catalyzed silicone in the mold between about 30 and 60 seconds.

These and other aspects and embodiments of the present invention will now be described in detail with reference to the accompanying drawings, wherein:

DETAILED DESCRIPTION

Figure 1:
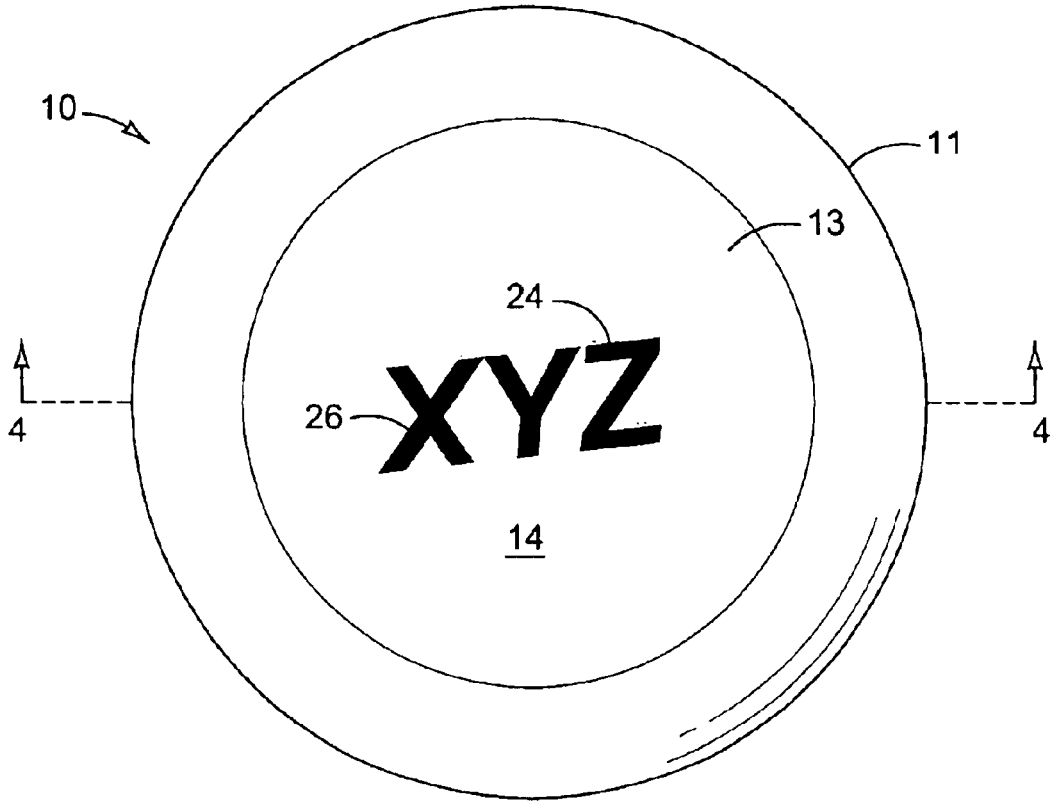
FIG. 1 is a top plan view of a Flexible Flying Disk depicting features of the present invention.
Figure 2:
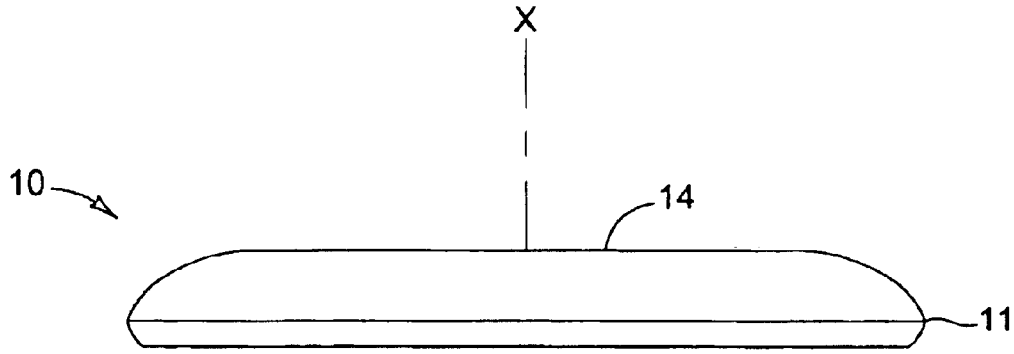
FIG. 2 is a side elevation view of the Flexible Flying Disk depicted in FIG. 1.
Figure 3:
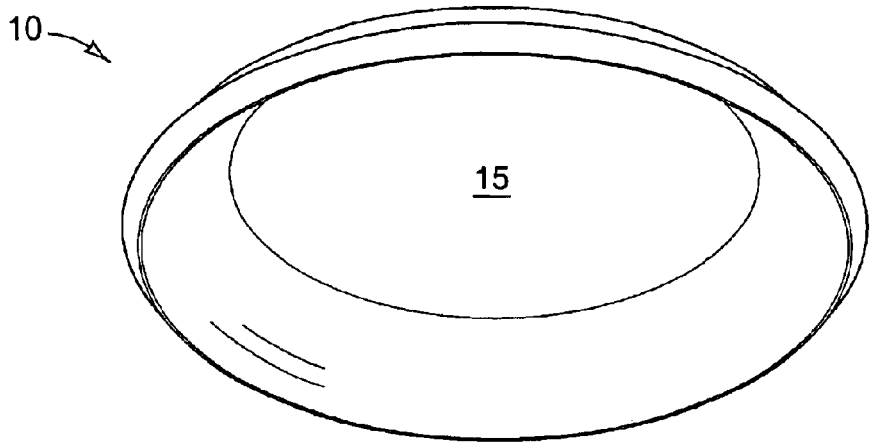
FIG. 3 is a perspective view of the Flexible Flying Disk depicted in FIG. 1.
Figure 4:
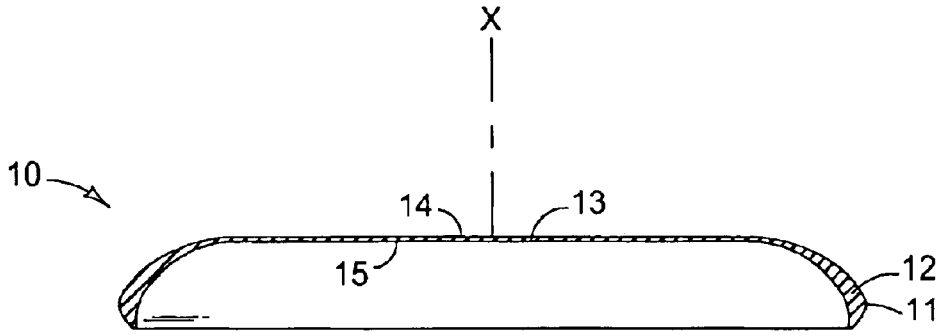
FIG. 4 is a sectional view taken substantially along line 44 in FIG. 1.

Looking now to the drawings in greater detail, reference is first made to the flying disk which is generally indicated by the reference numeral 10. The disk 10 is provided as a throwing toy, with provisions that render the toy fun, safe, non-toxic, surprisingly resilient, and with a shape memory that is extremely difficult to defeat in normal use.

In accordance with one embodiment of the present invention, the body of disk 10 is defined in plan view by a substantially circular perimeter 11 enclosing a similarly substantially circular weighted annular margin 12. While the circular perimeter 11 can vary in diameter, it is advantageous to produce the disk 10 with a diameter between about 4 and 8 inches.

It has been found that disks within the above size range, and with characteristics exemplified below, have relatively low mass and particularly advantageous elasticity and resilience that enable them to be safe to throw in many areas without fear of causing damage.

The perimeter 11 circumscribes a weighted annular margin 12 of the disk 10. The margin 12 has an axial dimension measured along a central axis X that is advantageously about 0.11 (i.e., 11%) of the diameter. This relationship has been found to be advantageous in that a margin with this proportional relation to disk diameter is not so thick (along axis X) as to produce aerodynamic drag, but is axially thick enough to concentrate a substantial portion of the disk mass at its radial extremes.

The margin 12 is smoothly rounded about the perimeter to avoid sharp edges or corners, for safety, aesthetics, and aerodynamics. Further, the margin 12 transitions smoothly from the outer extremes of the disk, to a web 13 which spans the perimeter 11.

As depicted, the web 13 is disposed toward one axial side of the margin 12 and extends in a substantially transverse orientation with respect to the central axis "X". A thickness dimension, measured axially with respect to axis "X" is substantially less than the margin dimension. In one example, in a 4 inch diameter disk having an axial margin dimension of 0.45 inches, a web thickness of 0.03 was selected in order to maximize disposition of the disk mass primarily toward or at the margin 12.

The exemplary web 13 includes a top surface 14 and an opposed bottom surface 15. The bottom surface 15 curves smoothly to meet the margin 12, again for safety, aesthetics, and aerodynamics. However, the concave shape of the bottom surface 15 near the margin 12 is of a more gradual nature than the tighter curves at the perimeter 11. This curvature differential is filled by the elastomer thereby concentrating mass about the margin 12.

According to the present invention, the material making up the disk 10 is a synthetic, thermosetting heat curable silicone that when cured as described below, has a Shore A durometer value of between 20 and 60, but most preferably about 40, along with other properties that make the disk safe and fun to use. A useful material that can be molded and cured to these desired properties is produced by General Electric and has product number GE LIM 3745.

Figure 5:
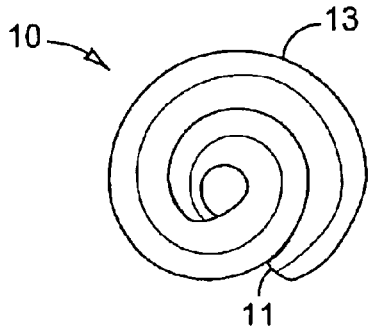
FIG. 5 is a side elevation view of the disk in a rolled configuration.

A disk, formed by this elastomer in the manner set forth below, exhibits surprising and advantageous properties. The cured material in the described disk form is extremely resilient, and has nearly infinite memory. That is, the disk will go back to its original configuration even after being crushed in a folded, wadded, or rolled condition (see FIG. 5). Thus, the disk can be stuffed into a pocket, crushed in a suitcase, bent and stretched in a toy box, but will always return to its original shape. Also, this material is non-toxic, and is very heat resistant, and can be formed into a safe, fun toy that can be thrown indoors or out without substantial fear that it will damage a struck object. For example the disk, thrown with force against a common glass window, will simply deform, absorbing the energy of impact rather than damaging the window. Plus, when formed into the disk shape and properly cured, the material will continue to hold the desired configuration and provide years of enjoyment.

Figure 6:
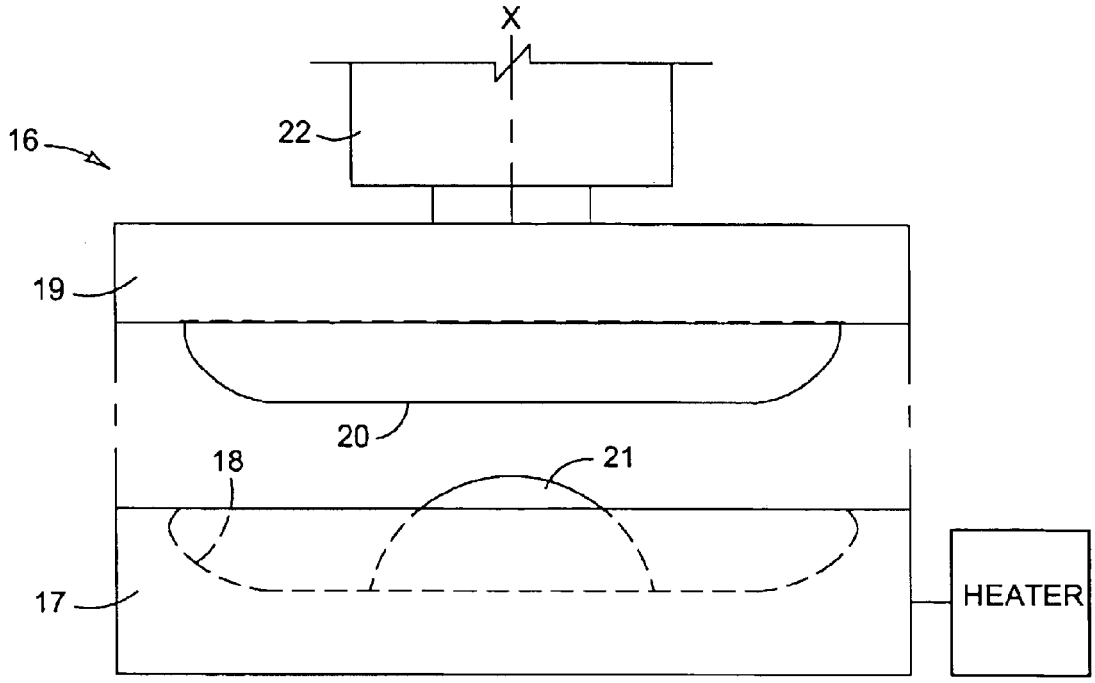
FIG. 6 is an operational schematic view illustrating a compression mold in an open position.
Figure 7:
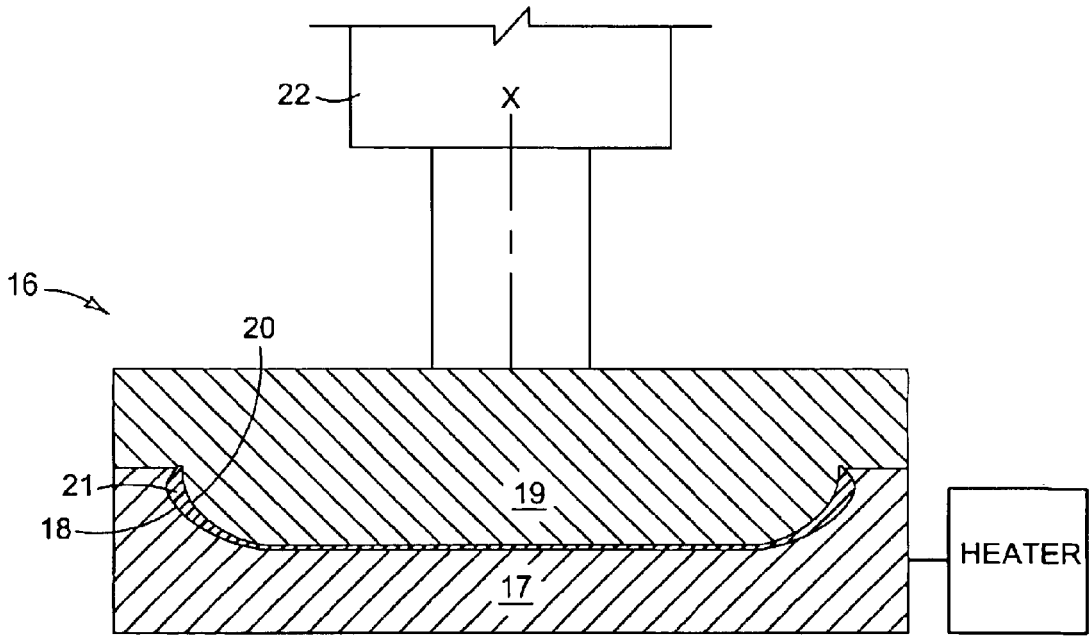
FIG. 7 is a partially sectioned view of the compression mold in a closed position.

FIGS. 6 and 7 show by way of schematic, a molding process that is useful in producing the present disk. A compression mold 16 is provided in which a first mold section 17, with an outwardly open cavity 18, is shaped to form one part of the disk configuration. A second mold part or section 19 is also provided, with a mold surface 20 formed thereon which mates in registration with the first mold section 17 so the surface 20 fits within the cavity 18 and produces a void in the shape of the disk body 10.

The mold 16 can be opened to gain access to the mold sections, so a measured amount of pre-catalyzed material 21 can be placed between the mold sections 17, 19. The volume of the material is selected to correspond with the volume of the disk.

The mold sections 17, 19 can be pre-heated to a temperature of about 350 degrees Fahrenheit for curing the material. This temperature, and pressure exerted by a source of force such as a hydraulic ram or pneumatic cylinder 22, or by equivalent mechanical means, serves to form and cure the material permanently into the desired shape and with the desired properties.

More specifically, the cylinder 22 can be operated to close the mold 16, and exert a selected force against the glob of material. It has been found that a force of about 4000 lbs per square inch of projected surface area of the disk is preferred for this compression molding process. That is to say, the cylinder 22, to produce a four inch diameter disk having a projected surface area of 12.566 square inches (as viewed in FIG. 1) would be driven to produce 12.566 in×4000 lb/in$^2$, or about 50,000 lbs of force against the material.

Heat curing is also applied to the mold 16. The mold 16 is heated to about 350 degrees Fahrenheit and held at that temperature for between 2-10 minutes depending upon whether the selected material (GE LIM 3745) includes tin, platinum, peroxide, or combinations thereof. In one example platinum has been used in the material to allow for a cure rate of about 2 minutes at 350 degrees.

Once the curing step is complete, the mold 16 can be opened and the finished disk is accessible for removal. The mold 16 is then ready for the next cycle.

Figure 10:
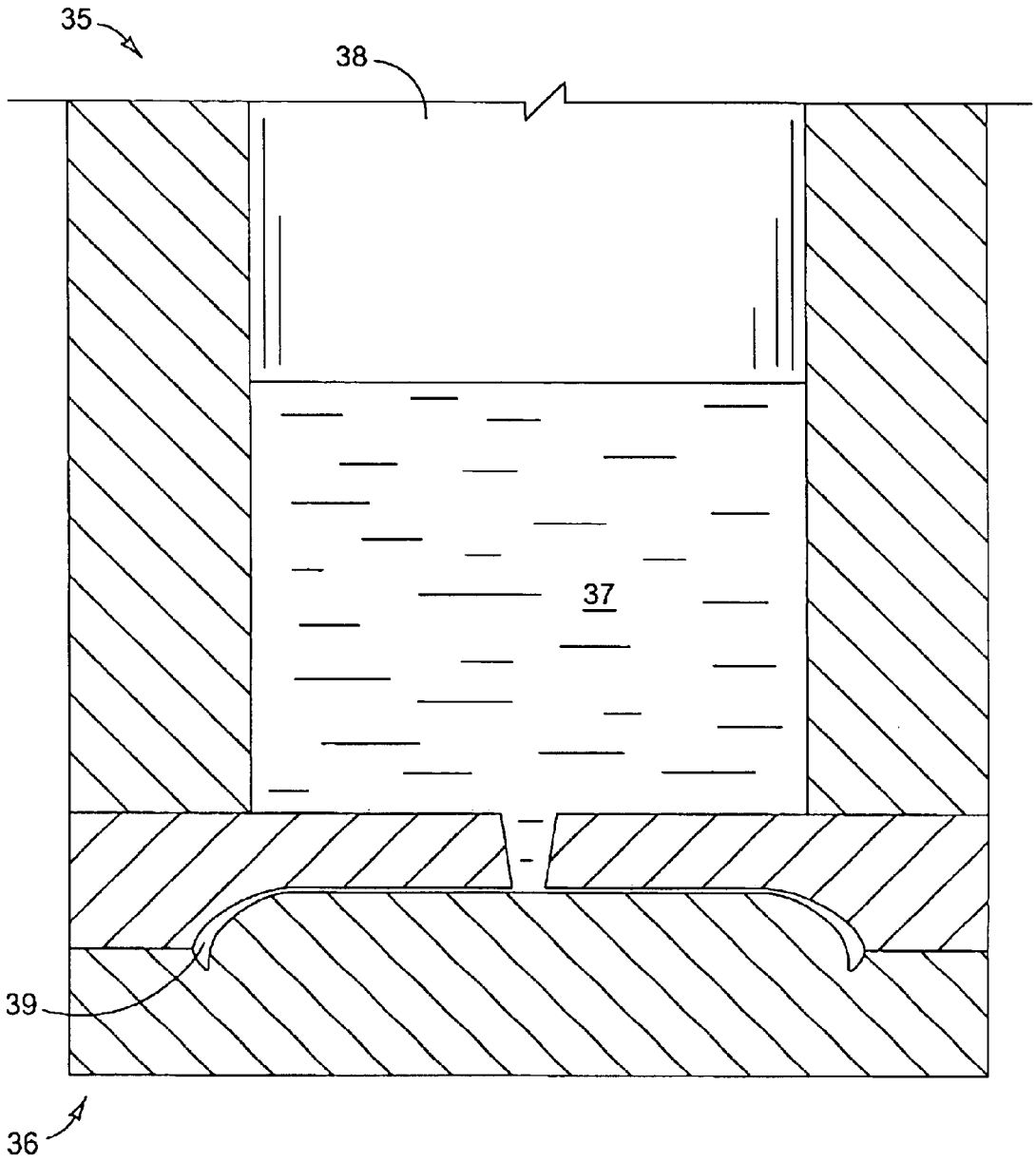
FIG. 10 is a schematic view of an injection mold arrangement for injection molding the disk.

In another aspect, the disk can be formed by injection molding using two mixed liquid parts of the silicone into a heated injection mold. FIG. 10 illustrates, by way of schematic, an exemplary molder 35. Here the mold pot 37 is filled or partially filled with the two part catalyzed silicone, and a ram 38 is used to force the liquid into the shaped cavity 39 of the mold 36. Curing can take place in this arrangement at a faster rate of about 30–60 seconds, at the 350 degree Fahrenheit temperature before the mold 36 is opened and the part is released. This technique can be used for higher production, because of the significantly lower cure time.

Figure 8:
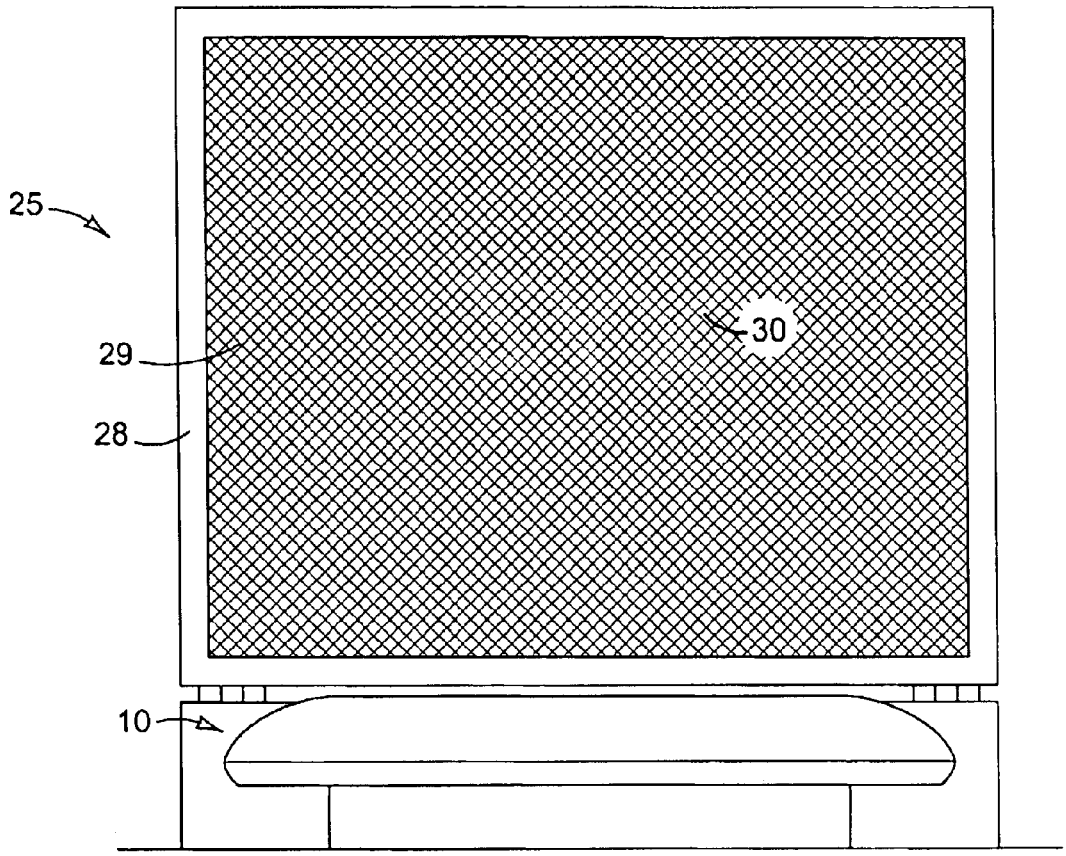
FIG. 8 is a schematic view of a silk screen printing arrangement for printing a graphic on the disk.
Figure 9:
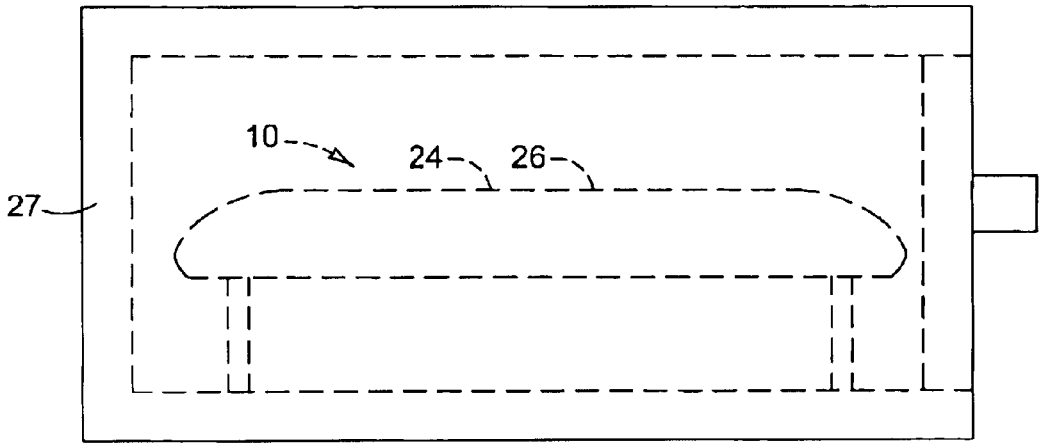
FIG. 9 is a schematic view of a curing oven with a disk identified inside by dashed lines.
Figure 11:
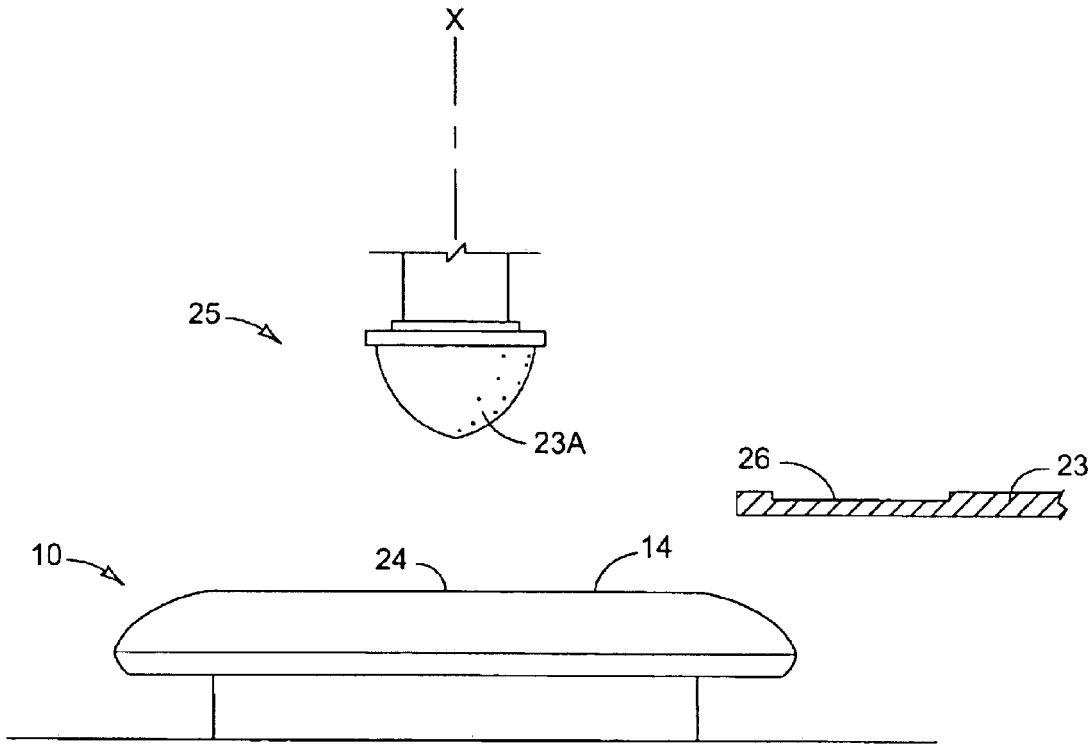
FIG. 11 is a schematic view of a pad printing arrangement.

FIGS. 8, 9, and 11 show printing of a graphic 24 on the disk. It has been found that ordinary inks will not adhere well to silicone, especially heat cured silicone of the nature described above. To alleviate this problem, and to provide a permanent image that will not crack, peel, or rub off, it is preferred to use silicone ink 26. A useful ink for this purpose is produced by GT Products Inc of Grapevine Texas.

The preferred ink is a two part solution that is mixed just prior to use. One part is ink and the other is a drier. Both parts are mixed in proportions suggested by the manufacturer for use within 24-48 hours.

FIGS. 8 and 11 generally depict a printer 25. In the version illustrated in FIG. 8, the printer 25 is in the form of a silk screen, with a screen frame 28, and a screen 29. The screen 29 is pressed against the disk 10 and the mixed ink is simply applied over the screen in the usual manner. The graphic image is thus formed on the disk 10.

It is been found to be advantageous, for curing the above ink, to place the freshly printed disk in an oven 27, where curing can be accomplished at 350 degrees Fahrenheit over a period of about 2 minutes.

FIG. 11 depicts the printer 25 in a pad printing procedure, in which the ink 26 is placed on the printer plate 23 and a flexible pad 23A is first pressed against the plate to receive the image from the plate, and is then pressed against the disk 10 to transfer the image from the pad 23A to the disk. The flexible pad 23A allows for curvature along the top surface 14 of the disk. The same or similar inks can be use in this arrangement, as can the curing at the temperatures and times given above.

It is noted that with either printing process described above, the disk will receive a printed graphic image that will bond with the silicone material of the disk. Thus the image will not rub off, crack or peel. Further, since the ink materials and disk materials are of a similar nature, the image formed will flex naturally with the disk and will not produce undesired reaction forces as the disk bends and stretches. Thus the graphic will not influence the shape of the disk when in flight.

Use of the present disk is facilitated by the construction described above. The disk can be thrown much in the same manner as known flying disk toys, using the same grip and arm motion. However, do to the described construction, the disk will initially deform in flight, due to the initial forces applied by the thrower's hand. But the inherent memory of the heat cured silicone material, and the mass of the margin 12 will quickly cause the disk to resume its initial shape, and the disk will fly to its target when aimed appropriately.

Should the disk be accidently or purposely thrown against an object, say a window, the flexible material will deflect, absorbing impact energy and minimizing or avoiding damage. Also, should the disk strike a playmate, the soft resilient material will not likely cause injury.

Catching the disk is another surprising advantage brought about by the described construction. The flexible, soft nature of the material and the disk configuration provide for easy gripping and users have experienced many successful catches. It has been found that the people catching the present disk are less intimidated by the softness of the disk body then they have been when catching harder plastic disks. They are therefor more likely to attempt more catches and have more fun in the process.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A flexible flying disk, comprising:

a body having a circular perimeter formed about a central axis;

the body including a weighted annular margin at the perimeter, and wherein the annular margin defines an axial margin dimension;

a central web spanning the perimeter at one axial end of the margin, and wherein the central web defines an axial web thickness that is less than the axial margin dimension;

a visually discernable graphic on the body formed by silicone ink; and wherein the web and annular margin are integral and are formed of a thermosetting molded and heat cured catalyzed silicone.

2. The apparatus of claim 1, and wherein the silicone ink is a heat cured silicone ink.

3. The apparatus of claim 1, wherein the molded and heat cured catalyzed silicone includes a Shore A hardness durometer value of between approximately 20 and 60.

4. The apparatus of claim 1 wherein the molded and heat cured catalyzed silicone includes a Shore A hardness durometer value of approximately 40.

5. The apparatus of claim 2, and further comprising:

wherein the molded and heat cured catalyzed silicone includes a Shore A hardness durometer value of approximately 40.

6. A process for producing a flexible flying disk, comprising:

providing a first mold part with an outwardly open cavity formed therein defining part of a circular flying disk configuration;

providing a second mold part with a mold surface thereon defining a remaining part of the circular flying disk configuration;

placing a pre catalyzed volume of silicone within one of the mold parts:

pressing the mold parts together at a equal to about 4000 pounds per square inch of projected surface area of the flying disk configuration;

heating the mold parts to a temperature of about 350 degrees Fahrenheit for a time period of between about 2 and 10 minutes to cure the pre-catalyzed silicone; and separating the mold parts to allow removal of the cured flying disk.

7. The process of claim 6, and further comprising printing a graphic on the cured disk using silicone ink.

8. The process of claim 6, and further comprising printing a graphic on the cured disk using silicone ink; and heat curing the silicone ink.

9. The process of claim 6, and further comprising printing a graphic on the cured disk using silicone ink; and heat curing the silicone ink at a temperature of about 350 degrees Fahrenheit for about 2 minutes.

10. The process of claim 6, and further comprising printing a graphic on the cured disk by:

providing a printing plate with the graphic thereon;

applying a silicone ink to the printing plate;

pressing a flexible pad against the printing plate to transfer ink from the printing plate to the flexible pad; and subsequently pressing the flexible pad onto the cured disk, to transfer the ink from the flexible pad to the disk; and heat curing the silicone ink at a temperature of about 350 degrees Fahrenheit for about 2 minutes.

11. The process of claim 6, and further comprising printing a graphic on the cured disk by:

providing a silk screen with the graphic thereon;

applying the screen to the body;

spreading a silicone ink over the graphic on the silk screen;

lifting the screen from the body to leave a silicone ink graphic image on the body; and heat curing the silicone ink at a temperature of about 350 degrees Fahrenheit for about 2 minutes.

12. A flexible flying disk produced by the process of claim 6.

13. A flexible flying disk, comprising:

a body formed of heat cured silicone having a Shore A durometer of between about 20 and 60, and having a circular perimeter with a diameter of between about 4 and 8 inches centered on a central axis;

the body including a weighted annular margin at the perimeter;

wherein the annular margin defines an axial margin dimension that is about 0.11 of the diameter;

a central web spanning the perimeter at one axial end of the margin;

wherein the central web includes an axial web thickness that is about 0.007 of the axial margin dimension;

an image formed of silicone ink on the body, and wherein the web and annular margin are integral.

14. The apparatus of claim 13, and wherein the silicone ink is a heat cured silicone ink.

15. The apparatus of claim 14, and wherein the image comprises a silk screened visual image.

16. A process for producing a flexible flying disk, comprising:

providing a mold formed of two separable parts that together form a flying disk shaped cavity;

heating the mold to about 350 degrees Fahrenheit;

injecting liquid catalyzed silicone into the heated mold;

curing the injected liquid catalyzed silicone in the mold for between about 30 and 60 seconds; and applying a visually discernable graphic on the flexible flying disk using silicone ink.

17. The process of claim 16, and wherein the visually discernable graphic is applied to the flexible flying disk by pad printing, the process further comprising heat curing the silicone ink.

18. The process of claim 16, and wherein the visually discernable graphic is applied to the flexible flying disk by silk screening, the process further comprising heat curing the silicone ink.

19. The process of claim 16, and wherein the curing is carried out at a pressure of approximately 4000 lbs per square inch of projected surface area of the flexible flying disk.

* * * * *